US005605615A

United States Patent [19]

Goolsby et al.

[11] Patent Number: 5,605,615

[45] Date of Patent: Feb. 25, 1997

[54] METHOD AND APPARATUS FOR PLATING METALS

[75] Inventors: Peter G. Goolsby, Phoenix; Dan R. Ramirez, Chandler; Lei P. Lai, Glendale, all of Ariz.

[73] Assignee: Motorola, Inc., Schaumburg, Ill.

[21] Appl. No.: 349,590

[22] Filed: Dec. 5, 1994

[51] Int. Cl.[6] ..... C25D 21/12; C25D 5/18; C25D 5/50; G01N 27/26

[52] U.S. Cl. ..... 205/83; 205/103; 205/104; 205/105; 205/106; 205/107; 205/108; 204/406; 204/434; 204/400; 204/DIG. 9; 204/228

[58] Field of Search ..... 204/406, 434, 204/400, 228; 205/83, 103, 104, 105, 107, 108, 102, 106

[56] References Cited

U.S. PATENT DOCUMENTS

| | | | |
|---|---|---|---|
| 4,018,658 | 4/1977 | Alfin et al. | 204/109 |
| 4,065,374 | 12/1977 | Asami | 204/228 |
| 4,120,759 | 10/1978 | Asami | 204/14 R |
| 4,461,680 | 7/1984 | Lashmore | 205/104 |
| 5,156,729 | 10/1992 | Mahrus et al. | 205/104 |

FOREIGN PATENT DOCUMENTS

| | | |
|---|---|---|
| 1144756 | 3/1969 | United Kingdom . |
| 1534117 | 11/1978 | United Kingdom . |

OTHER PUBLICATIONS

Bahnck et al., "Bipolar, Constant–Current, Electroplating Power Supply", Western Electric Technical Digest, No. 29 (Jan. 1973), pp. 5–6.

Cohen et al., "A Microprocessor Controlled Potentiostat for Electrochemical Measurements", Journal of Research, vol. 83, No. 5 (Sep.–Oct. 1978), pp. 429–443.

J. Puippe et al., "Theory and Practice of Pulse Plating" published by American Electroplaters and Surface Finishers Society, 1986, pp. 1, 2, 5, 8, 23, 38, 43, 52, 53, and 124 no month.

Lowenheim, *Electroplating,* no month, 1978, p. 140.

Harris, *Quantitative Chemical Analysis,* no month, 1982, pp. 424–426.

Jernstedt, "Better Deposits at Greater Speeds by PR Plating", pp. 1–6. Jul. 1948.

*Primary Examiner*—Kathryn Gorgos
*Assistant Examiner*—Edna Wong
*Attorney, Agent, or Firm*—Miriam Jackson

[57] ABSTRACT

A method and apparatus for plating metals which delivers a voltage pulse with the possibility of a widely varying current magnitude characteristic to a plating electrode and an object having a large electrical reactance in terms of a parallel resistance and capacitance in order to raise the voltage potential between the electrode and an object to a programmed plating voltage overpotential and underpotential. The programmed plating voltage overpotential determines how fast the electrochemical reaction is allowed to proceed in the diffusion layer, and the programmed voltage underpotential determines how quickly the electrochemical reaction of the diffusion layer will slow down.

12 Claims, 3 Drawing Sheets

-PRIOR ART-

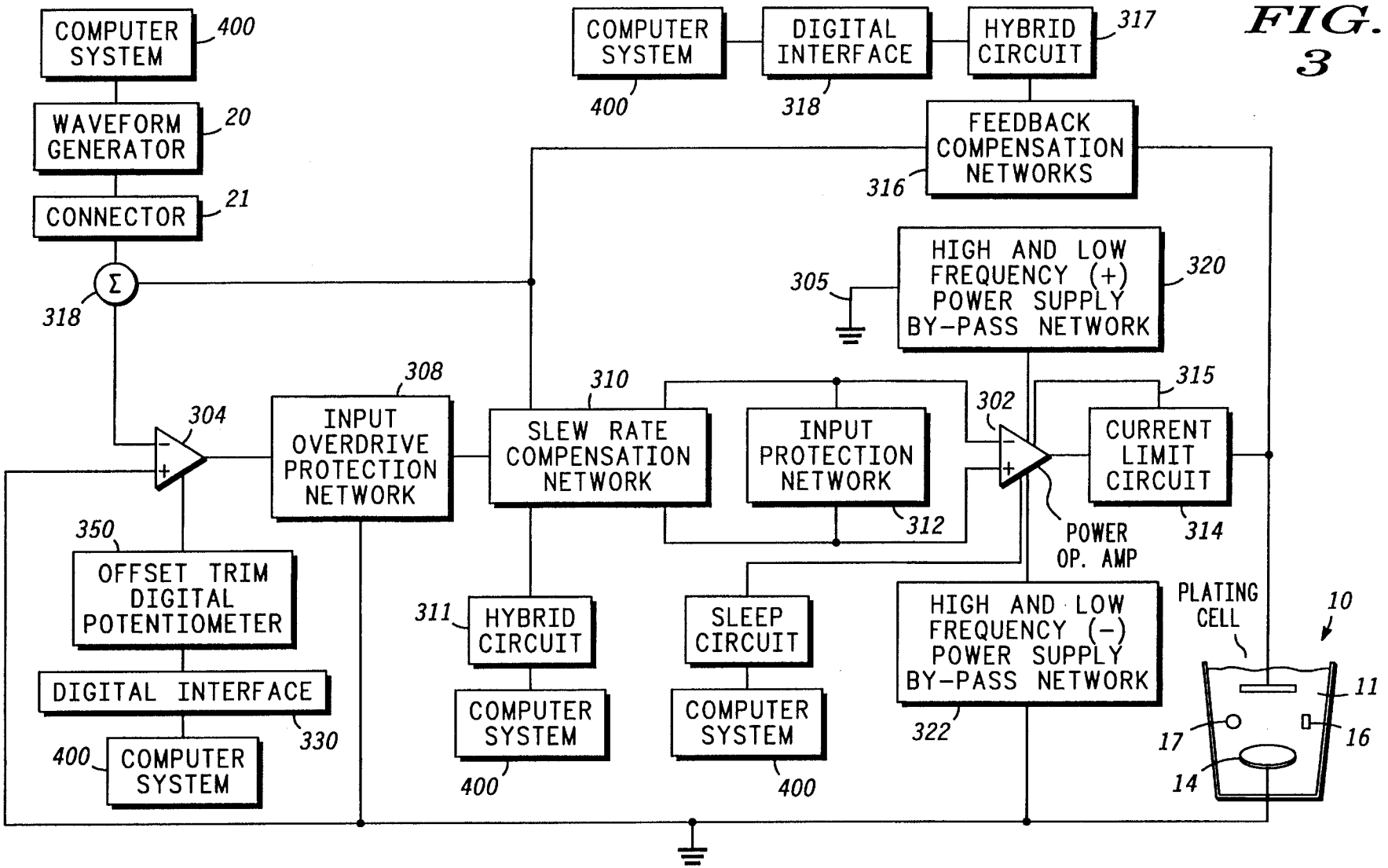
FIG. 3
10
11
16
PLATING CELL
17
14
HYBRID CIRCUIT
317
DIGITAL INTERFACE
318
COMPUTER SYSTEM
400
FEEDBACK COMPENSATION NETWORKS
316
HIGH AND LOW FREQUENCY (+) POWER SUPPLY BY-PASS NETWORK
320
305
315
CURRENT LIMIT CIRCUIT
314
POWER OP. AMP
302
INPUT PROTECTION NETWORK
312
SLEW RATE COMPENSATION NETWORK
310
HIGH AND LOW FREQUENCY (−) POWER SUPPLY BY-PASS NETWORK
322
SLEEP CIRCUIT
COMPUTER SYSTEM
400
HYBRID CIRCUIT
311
COMPUTER SYSTEM
400
INPUT OVERDRIVE PROTECTION NETWORK
308
304
OFFSET TRIM DIGITAL POTENTIOMETER
350
DIGITAL INTERFACE
330
COMPUTER SYSTEM
400
COMPUTER SYSTEM
400
WAVEFORM GENERATOR
20
CONNECTOR
21
Σ
318

METHOD AND APPARATUS FOR PLATING METALS

BACKGROUND OF THE INVENTION

This invention relates, in general, to an apparatus and a method for plating metals, and more particularly, to an apparatus and method of plating interconnects on electronic products.

The plating process involves an electrochemical process where a layer of metal is deposited on a surface by creating a voltage potential between the surface to be deposited on and the electrode. In the electronics industry, this plating apparatus and method is used to plate a metallic layer on a portion of a semiconductor wafer to form interconnections, wire bond sites, flip chip bond sites, or tape automated bond sites.

The plating systems used in the past had the problem of indeterminate control of the charging and discharging characteristics of the electrochemical diffusion layer which resulted in nonuniform deposit characteristics across a wafer and nonplanar bump deposits. FIG. 1 depicts, using a scanning electron micrograph, such a plated bump deposit using prior manufacturing methods.

In the past, nonuniform deposits formed were formed because prior art plating systems could not operate at higher frequencies and higher currents required to minimize ion depletion of the diffusion layer. Another problem with the prior art was imprecise control of the plating parameters with regard to the control of voltage and current forcing modes, and the precision and bandwidth of the programmed duty cycle and frequency response. Additionally, prior systems were not capable of maintaining consistent peak operating current profiles at the required higher pulse plating frequencies that are needed during a plating solution's effective manufacturing lifetime.

Prior art methods rely upon operational amplifiers to sense current demands over a period of time that is relatively long compared to the length of a pulse period. The prior art's operational amplifiers are configured as a integrator circuit that has an integration time constant of approximately 20 seconds. This means that an instantaneous change in current demand for a short period of time cannot be responded to very fast. The prior art's operational amplifier integrator circuit's output is tied into the gate of a MOSFET voltage controlled device. The MOSFET acts as a current regulator, in that as the gate voltage is increased, the MOSFET is biased "on" more, and this action allows more current to flow into the electrochemical reaction cell through the bridge circuit. This gate voltage is what takes so long to be affected by the operation amplifier integrator circuit.

The net effect of the prior art's circuit is that it's ability to charge the electrical reactance of the electrochemical diffusion layer on the object to be plated (essentially a paralleled capacitor and resistor) is limited with increasing frequency. As the frequency increases past about 30 Hz, the electrochemical time constant of the diffusion layer overrides the ability of the prior art's circuit to charge the electrochemical diffusion layer. Because the amount of charge transfer is limited to the electrochemical diffusion layer on the rising and falling edges of the prior art's circuitry in both voltage and current control modes, but primarily in voltage control mode, the results of using the prior art equipment cause inconsistent and unpredictable metal deposits to form.

In particular to the electronics industry, the problems described above, in addition to other problems of the systems used in the past, resulted in intolerable process variation of the metal deposition thickness, planarity, grain structure and deposit hardness from wafer to wafer and between interconnection bond sites within a wafer. As can be seen, a system for providing an enhanced level of control of the electrochemical process and optimization of the resulting metal deposition is needed.

BRIEF DESCRIPTION OF THE DRAWINGS

FIG. 3 is a circuit diagram of a circuit element used in an embodiment of the present invention.

DETAILED DESCRIPTION OF THE DRAWINGS

This invention allows for the plating of metal deposits onto a semiconductor wafer substrate having a conductive metallized seed layer of uniform thickness and planar topography. This invention facilitates the deposition of various metallic substances electrochemically from aqueous dissolved metal and chemical solutions onto the seed layer of semiconductor wafers. This is especially advantageous in the electronics industry where uniformity and planarity of microfeatures are required from device to device on semiconductor wafers comprised of many thousands or even tens of thousands of microfeatures present on a single wafer. Uniformity and planarity are necessary to maintain adequate assembly yields during manufacturing with little adjustment of precision semiconductor final manufacturing and assembly equipment. It is well known in the art that a plating system may be easily converted to a system that etches a metal instead of depositing a metal.

A plating system will be disclosed below which solves the problems of the systems of the past were not capable of determinate control of the charging and discharging characteristics of the electrochemical diffusion layer, precise control of pulse plating parameters, true voltage forcing and current forcing, precision calibration across a wide range of plating voltages and currents, true AC and DC forcing of both voltage and current, independent control of each plating reaction cell, precision timing of the pulse waveform and reaction times, and simple and repeatable calibration of system hardware.

Figure 2:
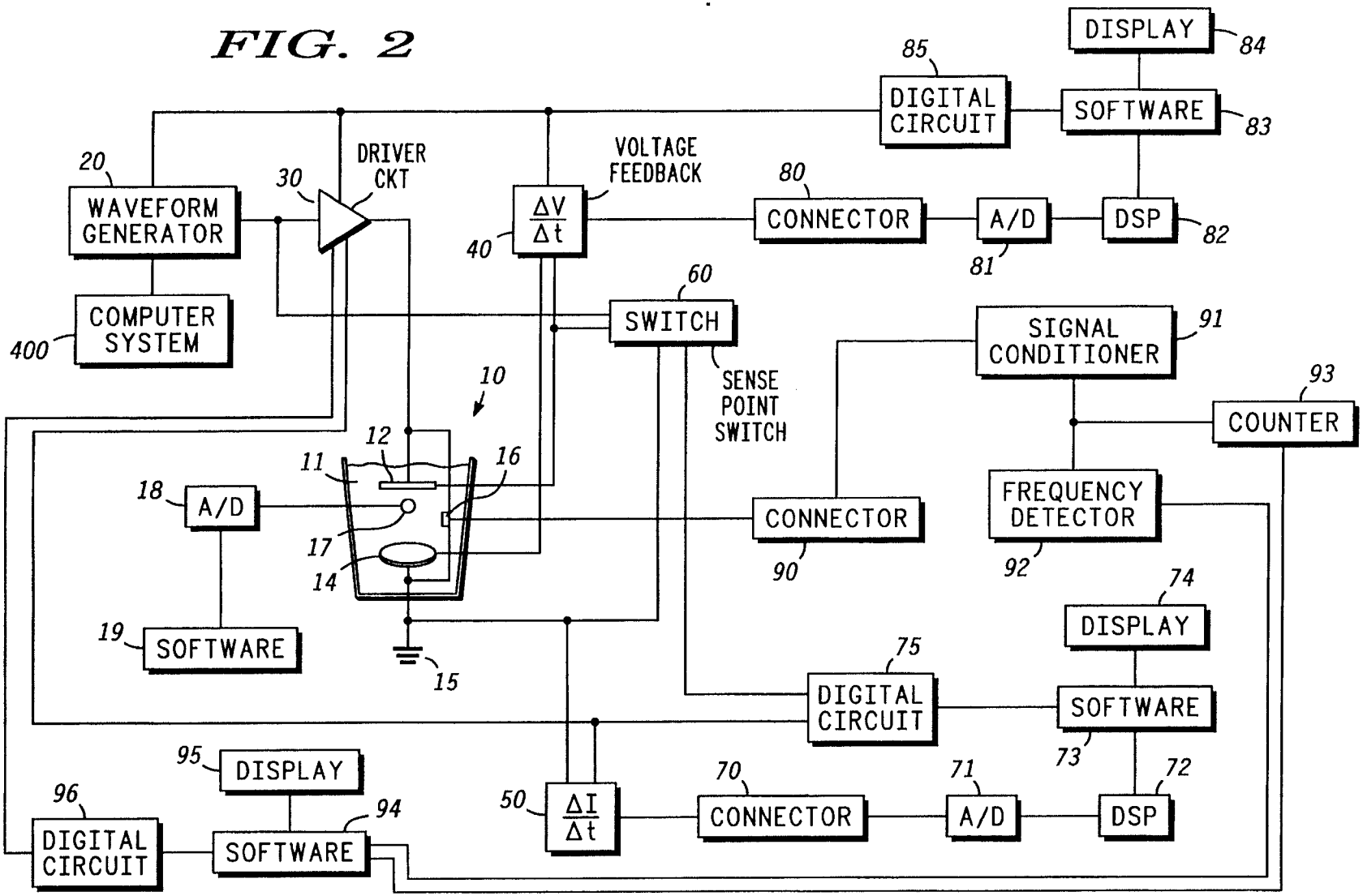
FIG. 2 is a block diagram of an embodiment of the present invention.

FIG. 2 illustrates an embodiment of the present invention. A plating cell 10 is provided having a electrochemical solution 11 in which an electrode 12 and an object to be plated (object) 14 is positioned. A Quartz Crystal Microbalance 16 is immersed in electrochemical solution 11 in order to detect the thickness of the metal as it is deposited on object 14. In one example, object 14 is comprised of a semiconductor wafer. A conductivity sensor 17 is also immersed in electrochemical solution 11 in order to provide a signal to analog-to-digital converter (A/D) 18 which is coupled to software 19. Software 19 receives and processes the conductivity signal in order to determine the resistance of electrochemical solution 11 between electrode 12 and object 14.

A plating cell driver circuit (driver circuit) 30 is coupled to an input 20 and electrode 12. Plating cell driver circuit 30 receives a control signal from a waveform generator 20.

Control signals may be generated by a waveform generator source or other means. In voltage forcing mode, plating cell driver circuit 30 alters either the applied voltage pulse characteristics with regard to the multiple voltage levels and duty cycles that are applied to plating cell 10 in response from software algorithms controlled by computer system 400 that stimulate an electrochemical reaction, producing the desired metallic deposit characteristics in plating cell 10. In current forcing mode, plating cell driver circuit 30 alters the applied current pulse characteristics with regard to the multiple current levels and duty cycles that are applied to plating cell 10 in response from software algorithms controlled by computer system 400 that stimulate an electrochemical reaction, producing the desired metallic deposit characteristics in plating cell 10.

Switch 60 selects the mode of operation for the system. In the default position, switch 60 selects voltage forcing mode, whereby driver 30 outputs a programmable pulse train of multiple levels of voltages at programmable duty cycles and programmable frequencies. Switch 60 is a sense point selector that is controlled by a digital signal source from a computerized control element 75. Switch 60 routes the voltage sensed from electrode 12 through a feedback network of wires to the input of driver 30 and waveform generator 20. The sensed voltage at electrode 12 provides a means to close a feedback loop to driver circuit 30 and waveform generator 20 to ensure stability and compliance to programmed voltages from small signal waveform generator 20 through amplifier 30, and at the electrode 12.

In the secondary position, switch 60 selects current forcing mode, whereby driver 30 outputs a programmable pulse train of multiple levels of currents at programmable duty cycles and programmable frequencies. Switch 60 routes the current sensed through plating cell 10 to the input of driver circuit 30 and waveform generator 20. The sensed current through plating cell 10 provides a means to close a feedback loop to driver circuit 30 and waveform generator 20 to ensure amplifier stability and compliance to programmed currents from small signal waveform generator 20 through driver circuit 30, and through plating cell 10. The operation of the plating system in current sensing mode and voltage sensing mode will be further described below.

QCM 16 is immersed in electrochemical solution 11 for the purpose of monitoring the thickness of the metal deposit during a plating session. QCM 16 is electrically in parallel with electrode 12 and object 14 when driver circuit 30 is in voltage forcing mode. Voltage forcing mode is defined as being the state that driver 30 is in when driver 30 supplies a fixed level of voltage pulses of set frequency and duty cycle to the electrode 12 whereby the current delivered to plating cell 10 varies, depending on the surface area being plated onto of object 14, the hydrodynamics of the fluid flow past the plated surface, and the ion concentration of metallic electrochemical solution 11, and other factors. QCM 16 thereby becomes an additional area that is plated onto during a semiconductor wafer plating session that consumes current in manner proportionate to object 14 being plated.

In a preferred embodiment, the crystal of QCM 16 is a flat circular plate 1.0 inch in diameter and 0.015 inches thick. The crystal is electrically excited at it's resonant frequency, typically as part of an oscillator circuit. The crystal vibrates in the thickness shear mode at a rate of several MHz. The crystal is mounted into the end of a probe which is inserted into electrochemical solution 11. An electrical cable connected to connector 90 transmits the signal of QCM 16 to a signal conditioner 91. Signal conditioner 91 uses Schmitt trigger circuitry to square up the asymmetrical pulse characteristics of the signal of QCM 16. The signal of QCM 16 from signal conditioner 91 is coupled to a frequency detector 92 and is also coupled to a digital counter 93.

The frequency sensitivity of plating crystals is very high. One micron of thickness plated onto QCM 16 produces a frequency change of about 160,000 Hz in the base transmitted frequency. It can be seen that resolving this frequency change is relatively simple with high speed digital counter 93. Additionally, it can bee seen that it is a straightforward concept to detect the rate at which metal is being deposited onto object 14 by intermittently enabling QCM 16, determining the frequency of oscillation, disabling the QCM and waiting a programmable and determinate time interval, and remeasure the frequency of oscillation, thereby determining the difference in frequency. This technique yields the plating rate between the two or more sample periods.

It is not necessary to have QCM 16 always enabled during a semiconductor plating session. The technique described above economizes the use of the QCM 16 crystals, as they have a finite lifetime, after which they must be replaced. The lifetime of QCM 16 depends upon the mass of the metal deposited onto the oscillatory microbalance structure.

Frequency detector 92 and digital counter 93 are both coupled to software 94. Software 94 determines, displays on a video display 95, and tracks the plating rate of the electrochemical reaction during plating and will shut down the plating process when a user programmed plating thickness is reached. The plating process is stopped when software 94 sends a digital signal to a control element 96 which is digitally coupled to waveform generator 20 and driver circuit 30. Control element 96 signals waveform generator 20 to tristate its output to driver circuit 30, and control element 96 also signals driver circuit 30 to go into "sleep" mode, whereby the output of driver 30 is effectively electrically isolated from electrode 12 such that virtually no current will flow through plating cell 10.

Voltage Forcing Mode

With reference to FIG. 2, the voltage delivered to plating cell 10 is monitored by a voltage sense feedback circuit 40 which is preferably coupled to a point very near where driver circuit 30 is attached to electrode 12. The purpose of having these two points physically close to each other is to minimize IR or voltage drop errors between the sense point of the voltage sense feedback circuit 40 and the high power connection of driver circuit 30.

The output of voltage sense feedback circuit 40 is coupled through a electrical cable to a connector 80. Connector 80 is coupled to analog-to-digital converter (A/D) 81. A/D converter 81 changes the differentially sensed voltage into a signal that can be transmitted by digital means across a computer interface to a Digital Signal Processor (DSP) 82. DSP 82 receives the encoded pulse waveform that is representative of the voltage measured across plating cell 10. This waveform is digitized by A/D 81 at the rate of $250\times10^3$ samples/second. DSP 82 utilizes, in conjunction with software algorithm 83 through digital filtering techniques, and pulse parameter characteristic determination techniques, the following characteristics about the differentially sensed voltage across plating cell 10:

| | |
|---|---|
| Slew rate | Duty Cycle |
| Overshoot | 1st Derivative |
| Risetime | Offset error |
| Top | Maximum Peak Voltage |
| Amplitude | Minimum Peak Voltage |

-continued

| | |
|---|---|
| Base | RMS voltage |
| Undershoot | Average Voltage |
| Falltime | Noise Margin |
| Width | Spectrum Analysis |
| Delay | Pulse Variance |

Software 83 uses these derived parameters to update video display 84 and transmit encoded control signals to control element 85. Control element 85 contains digital circuitry that interfaces to voltage feedback circuit 40, waveform generator 20 and driver circuit 30. The first purpose of control element 85 is to sense the offset error in the output of voltage feedback circuit 40 and provide a control signal to nullify this error using a digital potentiometer included in voltage feedback circuit 40. The control signal affecting the offset of said voltage sense feedback circuit is derived from the interaction of A/D 81, DSP 82 and software 83.

The second purpose of control element 85 is to use the results of analyzing the differentially sensed voltage pulse waveform together with pulse parameter characteristic determination techniques to provide digital control feedback to driver circuit 30 which contains additional internal control elements that control the loop stability of driver circuit 30 amplifiers. These same digital control feedback signals from control element 85 provide offset error control to driver circuit 30 when driver circuit 30 is in voltage forcing mode, and these same digital control feedback signals from control element 85 provide slew rate, rise time, fall time, overshoot and undershoot control via internal circuitry contained within driver circuit 30, and by doing so, makes electronic adjustments to driver circuit 30 in order to ensure driver circuit 30 remains stable to the stimulus from waveform generator 20, and that driver circuit 30 delivers a precise waveform of the desired slew rate, risetime, falltime, overshoot and undershoot to electrode 12.

Thus, the method and apparatus of the present invention compensates for a change in the dimension of the area being plated by instantaneously varying the supplied current in the voltage control mode in order to maintain constant current density independent of instantaneously varying areas being plated, and invention varies the supplied plating current in response to changing plating area fluctuations by maintaining an exact programmed voltage pulse to the plating reaction cell 10.

In the voltage forcing mode, the invention allows programmed voltages to vary the difference between the programmed overpotential and programmed underpotential values such that the corresponding plating current profiles may be monitored and changed by adjusting the difference between the programmed overpotential and underpotential values by manual or computerized algorithms such that constant surface morphology responses are realized by using this invention.

In voltage forcing mode this invention provides a method to rapidly charge and discharge the electrochemical diffusion layer encountered in semiconductor wafer manufacturing with sufficient current to maintain a constant current density independent of varying plating area while maintaining exact programmed voltage pulses across electrode 12 and object 14 to produce the desired morphological response. The effect of this invention upon the electrochemical diffusion layer present in semiconductor wafer plating is to charge the electrode 12 and object 14 up so fast, that a electrochemical reaction proceeds quickly and stops quickly, prior to the ion concentration of the electrolyte being depleted into an ion starvation mode. In order to accomplish this action, very high power, fast electronics are necessary to operate at the higher frequencies and rapid slew rates necessary.

Current Forcing Mode

With reference to FIG. 2, the current delivered to plating cell 10 is monitored by a current sense feedback circuit 50 which is preferably coupled to a point above analog ground 15 and between a low ohmage precision resistor positioned between current sense feedback circuit 50 connection below object 14 and analog ground 15. Current sense feedback circuit 50 is differentially coupled between object 14 and analog ground 15. The output of current sense feedback circuit 50 is preferably coupled through a electrical cable to a connector 70. Connector 70 is coupled to an analog-to-digital converter (A/D) 71. A/D converter 71 changes the differentially sensed current into a signal that can be transmitted by digital means across a computer interface to a Digital Signal Processor (DSP) 72. DSP 72 receives an encoded pulse waveform that is representative of the current flowing through plating cell 10. In a preferred embodiment, this waveform is digitized by A/D 71 at the rate of $250\times10^3$ samples/second in order to accurately represent the current flowing in plating cell 10.

DSP 72 utilizes, in conjunction with a software algorithm 73 through digital filtering techniques, and pulse parameter characteristic determination techniques, the following characteristics about the differentially sensed current through plating cell 10:

| | |
|---|---|
| Slew rate | Duty Cycle |
| Overshoot | 1st Derivative |
| Risetime | Offset error |
| Top | Maximum Peak Current |
| Amplitude | Minimum Peak Current |
| Base | RMS current |
| Undershoot | Average Current |
| Falltime | Totalized Current |
| Width | Spectrum Analysis |
| Delay | Pulse Variance |

Software 73 uses these derived parameters to update video display 74 and transmit encoded control signals to a control element 75. Control element 75 contains digital circuitry that interfaces to current feedback circuit 50, waveform generator 20 and driver circuit 30.

The first purpose of control element 75 is to sense the offset error in the output of current sense feedback circuit 50 and provide a control signal to nullify this error using a digital potentiometer included in current sense feedback circuit 50. The control signal affecting the offset of current sense feedback circuit 50 is derived from the interaction of A/D 71, DSP 72, and software 73.

The second purpose of control element 75 is to use the results of analyzing the differentially sensed current pulse waveform together with pulse parameter characteristic determination techniques to provide digital control feedback to driver circuit 30 which contains additional internal control elements that control the loop stability of driver circuit 30 amplifiers. These same digital control feedback signals from control element 75 provide offset error control to driver circuit 30 when driver circuit 30 is in current forcing mode, and these same digital control feedback signals from control element 75 provide slew rate, rise time, fall time, overshoot and undershoot control via internal circuitry contained within driver circuit 30. When the differentially sensed signal representing the current through plating cell 10, and the resistivity determined using conductivity sensor 17 in conjunction with A/D 18 and software 19 is processed using DSP 72, software 73 is able to make a determination of the electrical reactance of plating cell 10.

In summary, computer system 400, using input from A/D 71 and DSP 72 determines the exact resistance and the exact capacitance of the electrochemical reaction that is proceeding in plating cell 10 and by doing so, makes electronic adjustments to driver circuit 30 in order to ensure driver circuit 30 remains stable to the stimulus from waveform generator 20, and that driver circuit 30 delivers a precise waveform of the desired slew rate, risetime, falltime, overshoot, and undershoot to electrode 12.

In the current forcing mode the invention allows programmed currents to vary the difference between the programmed overcurrent and programmed undercurrent values such that the corresponding plating voltage profiles may be monitored and changed by adjusting the difference between the programmed overcurrent and undercurrent values by manual or computerized algorithms such that constant surface morphology responses are realized by using this invention.

Now with reference to FIG. 3, a circuit diagram of a preferred embodiment of driver circuit 30 is illustrated. Driver 30 is a unity gain composite inverting amplifier and comprised of a high power, high voltage power operational amplifier 302 (hereinafter operational amplifier 302) coupled to a small signal input offset minimization operational amplifier 304. In order to effectively control the diffusion layer boundary on object 14 an operational amplifier 302 that can deliver peak operating currents of 5 amps or more. More preferably, operational amplifier 302 should be able to deliver 15 amps or more to plate the areas that are typical in semiconductor manufacturing. A typical operational amplifier which can deliver less than 10 milliamps, which is not a power operational amplifier, will not be adequate for use in the present invention. Driver circuit 30 enables voltage or current forcing in the active reaction period and the inactive reaction period The purpose of composite amplification is to minimize output voltage and current difference errors from programmable input signal values transmitted to operational amplifier 302 from waveform generator 20 and to minimize the characteristicly large (>5 mV) input offset voltages present on typical high power operational amplifiers. Small signal input offset minimization operational amplifier 304 is coupled to analog ground 305.

Figure 1:
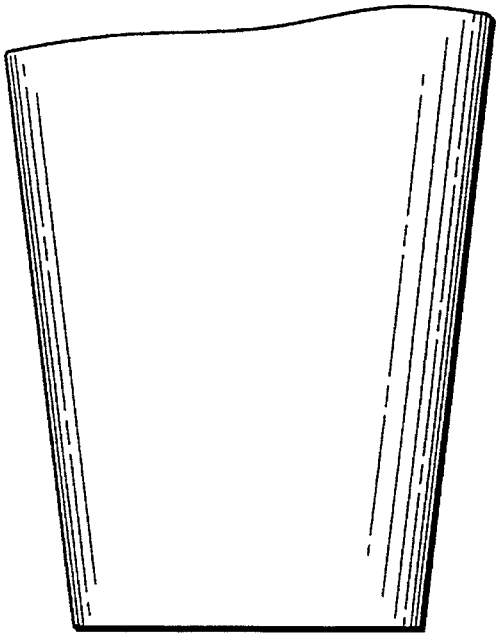
FIG. 1 is a scanning electron micrograph side view of a plated bump using prior art methods.

By using input offset trimming of the small signal input offset minimization operational amplifier 304, operational amplifier 302 is capable of maintaining input to output signal compliance of less than 1 millivolts of error between input to driver 30 to output to plating cell 10 across a driven current range of plus or minus 30 amps in current forcing mode or plus or minus 2.5 volts in voltage forcing mode. Offset trim digital potentiometer 305 is coupled to digital interface 330, digital interface 330 is coupled to computer system 400. Computer system 400 can determine the voltage offset of the output of the composite amplifier system by using elements 40, 80, 81, 82, 83 and 85 shown in FIG. 1. Computer system 400 then sends a digital control signal to offset digital trim potentiometer 350 in order to adjust and minimize input offset errors of the composite amplifier network (302,304).

Input overdrive protection network 308 is coupled to the output of operational amplifier 304 and to analog ground 305 to prevent excessive input overdrive during system startup. Input overdrive protection network 308 is coupled to slew rate compensation network 310. Slew rate compensation network 310 determines how fast the voltage input to operational amplifier 302 slews. The slew rate compensation network 310 is coupled to hybrid circuit 311, and hybrid circuit 311 is coupled to computer system 400.

The purpose of the interaction of elements 400, 311 and 310 is to use digitized waveform information to make decisions on how to compensate the composite amplifier (302,304) so it remains stable, such that the proper waveform characteristics are maintained in the pulses applied to plating cell 10. Computer system 400 preferably accomplishes this by using a techniques called 'noise gain compensation'. This method involves characterizing a 'past state' stability profile of the composite amplifier system, and then setting a series RC network contained within slew rate compensation network 310 and the hybrid circuit 311 to values such that the ratio of the feedback resistance across feedback compensation network 316 to the resistance across the combination of slew rate compensation network 310 and hybrid circuit 311 is large enough to ensure that the system gain crosses the open loop gain profile at a stable point. The capacitor in the hybrid circuit 311 is then set using computer system 400 to a corner frequency corresponding to 0.1 the open loop gain crossover frequency.

The input of slew rate compensation network 310 is coupled to the output of input overdrive protection network 308 and the output of feedback compensation network 316. The output of slew rate compensation network 310 is coupled to the input of input protection network 312.

Input protection network 312 prevents excessive voltage differences across operational amplifier 302. Input protection network 312 also prevents excessive output transients. Input protection network 312 is preferably comprised of six fast recovery diodes arranged three to a back to back protection network and in a dual reverse polarity configuration. The outputs of input protection network 312 is coupled to the inputs of operational amplifier 302. Operational amplifier 302 provides a high current output to plating cell 10.

The output of operational amplifier 302 is coupled to the input of current limit circuit 314. Current limit circuit 314 monitors peak current output from operational amplifier 302. Current limit circuit 314 will shut down operational amplifier 302 using a voltage feedback signal developed across an output current sense resistor 315 when peak current exceeds a predetermined current, in this embodiment, 15 amps. The output of current limit circuit 314 is coupled to the input of a feedback compensation network 316. Feedback compensation network 316 selectively filters the response of operational amplifier 302 and does so by receiving signals from computer system 400 coupled to digital interface 318, which is coupled to hybrid circuit 317. Hybrid circuit 317 in conjunction with feedback compensation network 316 combine to place a capacitor in the feedback path to cause a phase lead in the feedback which cancels the phase lag due to the capacitive loading nature of the electrochemical reaction 11 occurring in plating cell 10 during operation. Feedback compensation network 316 also provides the necessary voltage feedback as an output that is coupled to slew rate compensation network 310 and a summing junction 318. Preferably, summing junction 318 is comprised of three high precision 10,000 Ω, thin film resistors having the same value.

Feedback compensation network 316 is comprised of a selectively configurable parallel RC network. Waveform generator 20 is coupled to feedback compensation network 316 to allow waveform generator 20 to sense the error between its programmed voltage value and the driven voltage value of driver 30, and by doing so, waveform generator 20 is able to compensate for the error in input to composite amplifier circuit (302, 304) to the output from composite amplifier circuit (302, 304) in a manner within 5 mv. Additional input signal offset errors are compensated for by digital offset trim potentiometer 305.

Power supply high and low frequency bypass networks 320 and 322 prevent high frequency noise from being coupled into operational amplifier 302 or low frequency noise from being coupled into operational amplifier 302, respectively. Power supply high and low frequency bypass networks 320 and 322 are coupled to operational amplifier 302 and to ground 305.

The output of current limit circuit 314 is coupled to the input of plating cell 10, and completes a low impedance electrical connection to analog ground 305 through the electrochemical solution 11 during the electrochemical reaction at the surface of object 14 and through a low ohm current sense resistor positioned between object 14 and analog ground 305.

This invention solves the problem of a varying time constant of plating cell 10. Plating cell 10 begins with a short RC time constant, then increases as the byproducts increase in concentration. The system of the present invention will force the decay current to a manually determined level, or a programmed level achieved by computer system 400, as opposed to letting the current through electrode 12 and object 14 decay by the naturally occurring RC time constant present due to the electrochemical reaction. The decay current is controlled by the voltage or current forcing action of driver circuit 30. The decay current is forced to a determinate or indeterminate level by the driver circuit 30 responding to the stimulus of the waveform generator 20 and the feedback of the signal coming from the plating cell.

The invention is also intended to control a diffusion boundary layer. The diffusion boundary layer profile is set up by fluidic hydrodynamic conditions in the vicinity of the electrochemical reaction and can vary along a surface impairing tertiary current. The tertiary current exists when both activation and mass transfer effects contribute to the polarization resistance. The deposition reaction is controlled by mass transfer and the tertiary current depends mainly on the uniformity of the diffusion layer thickness. The voltage or current forcing ability of the system of the present invention in the on cycle (or active reaction period) and off cycle (or the inactive reaction period) of a pulse cycle allows higher frequencies to control the reaction time of the diffusion region layer. The diffusion layer is forced "on" just long enough to deposit an even layer of metal and achieve the desired morphological metallic deposits.

Figure 4:
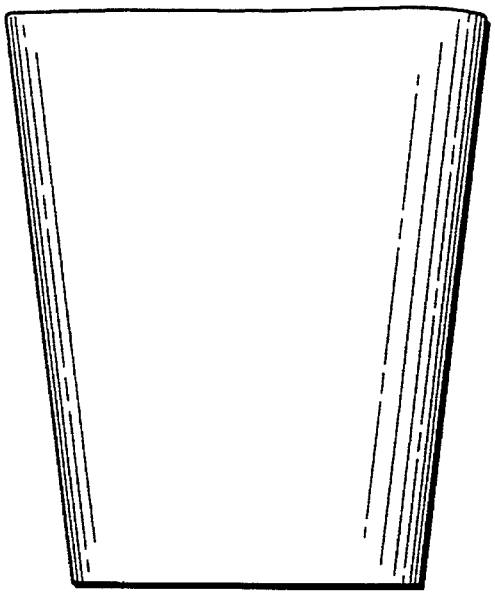
FIG. 4 is a scanning electron micrograph side view of a plated bump using an embodiment of the present invention.

FIG. 4 depicts, using a scanning electron micrograph, a typical bump deposit manufactured using precise control of the charge and discharge characteristics of the bath chemistry. The following data depicts typical uniform and repeatable microfeature growth by using this invention. This data was measured from two different semiconductor wafers culled from different manufacturing lots. The height profile data was recorded from a calibrated DekTak profilimeter common to the semiconductor manufacturing industry.

| WAFER SERIAL # | MEASUREMENT POSITION ON WAFER | HEIGHT READING [μ] |
|---|---|---|
| C7 | TOP MOST DIE | 20.70μ |
| C7 | CENTER DIE | 19.59μ |
| C7 | BOTTOM DIE | 21.02μ |
| C7 | LEFT DIE | 20.98μ |
| C7 | RIGHT DIE | 20.68μ |
| G4 | TOP MOST DIE | 20.84μ |
| G4 | CENTER DIE | 20.06μ |
| G4 | BOTTOM DIE | 21.27μ |
| G4 | LEFT DIE | 20.62μ |
| G4 | RIGHT DIE | 20.61μ |
| | STANDARD DEVIATION OF BUMP HEIGHT ON TWO WAFERS [μ] | 0.49μ |

As can be seen, the present invention controls plating process parameters with a high degree of resolution and a high degree of repeatable precision. The plating system has an enhanced degree of control of plating process parameters resulting in planar and more uniform deposits in which the metallic deposits morphological responses can be controlled accurately, resulting in reduced variability of deposit characteristics on semiconductor wafer interconnect microfeatures intrawafer and from wafer to wafer, and wafer lot to wafer lot during a plating solutions effective manufacturing lifetime by using this invention in conjunction with a electrochemical solution and a properly configured electrode 12 and object 14.

In addition, the present invention diminishes the effect that changing bath concentrations and corresponding bath conductivity and plating capacitance variability have upon metallic deposit morphological, e.g. the deposit profile, hardness, planarity and grain size characteristics by maintaining the process parameters with a high degree of resolution and precision.

Furthermore, the present invention provides a method to precisely deliver a voltage pulse with the possibility of a widely varying current magnitude characteristic to a plating electrode 12 and object 14 having a large electrical reactance in terms of the parallel resistance and capacitance electrochemical solutions exhibit in order to raise the voltage potential between the electrode 12 and object 14 to a programmed plating voltage overpotential that determines how fast the electrochemical reaction is allowed to proceed in the diffusion layer, and then also to a programmed voltage underpotential determining how quickly the apparatus will slow the electrochemical reaction of the diffusion layer.

We claim:

1. A plating system, comprising:

an electrode positioned for providing an electrical pulse to an electrochemical solution;

means for positioning an object to be plated in the electrochemical solution, wherein the object is adapted for coupling to ground;

a driver circuit comprised of a power operational amplifier coupled to the electrode to supply the electrical pulse to the electrode, wherein the power operational amplifier is comprised of at least a 15 amp device;

a control element coupled to the electrode and the driver circuit, wherein the control element provides offset error control and digital control feedback via the driver circuit; and an input coupled to the driver circuit.

2. The plating system of claim 1 further comprising: a voltage feedback circuit coupled to the object.

3. The plating apparatus of claim 1 further comprising:

an output of the current sense feedback circuit coupled to an analog-to-digital converter;

the analog-to-digital converter coupled to a digital signal processor; and the digital signal processor coupled to the driver circuit.

4. The plating system of claim 1 further comprising: a current sense feedback circuit coupled to the ground.

5. The plating system of claim 1 wherein the driver circuit is further comprised of:

a operational amplifier coupled to the power operational amplifier to provide unity gain composite inverting amplification.

6. The plating system of claim 1 wherein the power operational amplifier is comprised of a 15–30 amp device.

7. The plating system of claim 1 wherein the object is comprised of a semiconductor material.

8. A method of plating a metal layer, comprising the steps of:

providing an electrochemical solution;

providing an electrode in the electrochemical solution;

providing an object to be plated on in the electrochemical solution, the object having a diffusion layer and a plating area;

supplying a current or a voltage from a driver circuit coupled to the electrode sufficient to maintain a substantially constant current density in the electrochemical solution; and supplying offset error control and digital control feedback from control element coupled to the electrode and the driver circuit.

9. A method of plating a metal layer, comprising the steps of:

providing a plating cell comprising an electrode, wherein an electrochemical reaction is taking place in the plating cell, and the electrochemical reaction has an RC time constant;

supplying a current or a voltage to the plating sell from a driver circuit coupled to the electrode;

controlling a decay current in the plating cell to a first level so that the decay current is not solely a function of the RC time constant; and supplying offset error control and digital control feedback from a control element coupled to the electrode and the driver circuit.

10. The method of claim 9 wherein the step of controlling the decay current is achieved by a voltage or current forcing action of the driver circuit.

11. An electrochemical process, comprising the steps of:

providing an electrochemical solution;

providing a surface in the electrochemical solution, the surface comprised of a diffusion layer;

providing an electrode in the electrochemical solution;

creating a voltage potential between the surface and the electrode; and delivering a voltage or a current pulse to the electrode so that the voltage potential is set to a programmed plating voltage overpotential that determines how fast the electrochemical process proceeds in the diffusion layer and the voltage potential is set to a programmed voltage underpotential that determines how fast the electrochemical process will slow down the electrochemical process in the diffusion layer and wherein the diffusion layer is charged at frequencies equal to or above approximately 30 Hz.

12. The process of claim 11 wherein the step of delivering the voltage or the current pulse charges up the electrode and surface so that the electrochemical process proceeds prior to an ion concentration of the electrochemical solution being depleted into an ion starvation mode.

* * * * *